US010508638B2

(12) United States Patent
Nishio et al.

(10) Patent No.: US 10,508,638 B2
(45) Date of Patent: Dec. 17, 2019

(54) IGNITION DEVICE FOR INTERNAL COMBUSTION ENGINE

(71) Applicant: DENSO CORPORATION, Kariya, Aichi-pref. (JP)

(72) Inventors: Noriaki Nishio, Kariya (JP); Kanechiyo Terada, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/052,889

(22) Filed: Aug. 2, 2018

(65) Prior Publication Data

US 2019/0040834 A1 Feb. 7, 2019

(30) Foreign Application Priority Data

Aug. 4, 2017 (JP) ..... 2017-151390

(51) Int. Cl.

| | |
|---|---|
| ***F02P 3/05*** | (2006.01) |
| ***F02P 17/12*** | (2006.01) |
| *F02P 3/08* | (2006.01) |
| *F02P 9/00* | (2006.01) |

(52) U.S. Cl.

CPC ..... *F02P 3/05* (2013.01); *F02P 17/12* (2013.01); *F02P 3/0892* (2013.01); *F02P 9/007* (2013.01); *F02P 2017/121* (2013.01)

(58) Field of Classification Search

CPC .... F02P 3/05; F02P 3/045; F02P 17/12; F02P 9/00; F02P 9/002; F02P 9/007; F02P 2017/121

See application file for complete search history.

(56) References Cited

U.S. PATENT DOCUMENTS

2013/0192570 A1* 8/2013 Kajita ..... F01P 15/00 123/596

FOREIGN PATENT DOCUMENTS

| | | |
|---|---|---|
| JP | 2016-217320 | 12/2016 |
| JP | 2018-178997 | 11/2018 |
| WO | 2017/060935 | 4/2017 |

* cited by examiner

*Primary Examiner* — Jacob M Amick
(74) *Attorney, Agent, or Firm* — Nixon & Vanderhye PC

(57) ABSTRACT

An ignition device includes an ignition coil, an ignition plug and ignition control unit. The ignition control unit includes a secondary current adjusting unit that adjusts, in each cycle, an amount of the secondary current after initiating the discharge, a discharge extension detecting unit that detects an amount of extension of the discharge, and a short determination unit that determines whether a discharge-short has occurred. The ignition control unit controls the secondary current control unit such that a first step and a second step are repeatedly executed. The first step decreases the secondary current while keeping the secondary current higher than a predetermined lower current limit, when the extension amount detected by the discharge extension detecting unit is a predetermined extension amount or more. The second step increases the secondary current when the short determination unit determines that a discharge-short has occurred.

7 Claims, 12 Drawing Sheets

IGNITION DEVICE FOR INTERNAL COMBUSTION ENGINE

CROSS-REFERENCE TO RELATED APPLICATION

This application is based on and claims the benefit of priority from earlier Japanese Patent Application No. 2017-151390 Aug. 4, 2017, the description of which is incorporated herein by reference.

BACKGROUND

Technical Field

The present disclosure relates to an ignition device for an internal combustion engine.

Description of the Related Art

Ignition devices are used for ignition means for internal combustion engine such as a car. An example of an ignition device is provided with an ignition coil including a primary coil and a secondary coil which are magnetically coupled, and an ignition plug connected to the secondary coil, producing a discharge spark in a discharge gap. According to such an ignition device, primary current flowing through the primary coil is cut off, thereby causing high secondary voltage at the secondary coil. Then, the secondary voltage is applied to the ignition plug to produce a discharge at the ignition plug. The discharge spark produced by the ignition plug contacts an air fuel mixture in a combustion chamber, thereby igniting the air fuel mixture.

According to the above-mentioned ignition device, there is a concern that the discharge spark produced in the ignition plug may be extended by a stream of the air fuel mixture in the combustion chamber, thereby causing a blow-off of the discharge spark. For this reason, a technique of preventing the discharge spark from being blown off has been disclosed. For example, Japanese Patent Application Laid-Open Publication Number 2016-217320 discloses an ignition device in which a secondary current that flows through the secondary coil after starting discharge is controlled to be larger than a predetermined value. Thus, the ignition device according to the above patent literature maintains discharge at the ignition plug.

However, according to the ignition device of the above-described patent literature, there will be a concern that the discharge spark may be excessively swelled and extended towards a downstream side of the stream of the air fuel mixture. When the discharge spark is excessively swelled and extended, space between a part of the spark and another part of the spark is likely to be extended in a farther area (i.e., an area where the discharge spark is extended) with respect to the discharge gap so that short of the discharge spark between sparks is unlikely to occur, and a short of the discharge spark between sparks is likely to occur in an area close to the discharge gap since the space is likely to be narrower compared to the farther area. As a result, a positional change in the discharge spark due to occurrence of the short becomes larger so that heating points of the air fuel mixture may vary to lower the ignitability of the air fuel mixture.

SUMMARY

The present disclosure has been achieved in light of the above-described circumstances, and provides an ignition device of an internal combustion engine capable of improving an ignitability.

As a first aspect of the present disclosure is an ignition device of an internal combustion engine including: an ignition coil having a primary coil through which a primary current flows and a secondary coil in which a secondary current is produced with a change in the primary current; an ignition plug to which a secondary voltage generated at the secondary coil is applied to produce a discharge; and ignition control unit that controls an ignition operation of the ignition plug.

The ignition control unit includes: a secondary voltage detecting unit that detects the secondary voltage; a secondary current adjusting unit adjusts, in each cycle, an amount of the secondary current after initiating the discharge; a discharge extension detecting unit that detects an amount of extension of the discharge; and a short determination unit that determines whether a discharge-short has occurred based on the secondary voltage detected by the secondary voltage detecting unit, the ignition control unit is configured to control, in each cycle, the secondary current adjusting unit to repeatedly perform a first step that decreases the secondary current when the extension amount detected by the discharge extension detecting unit is a predetermined extension amount or more, and a second step that increases the secondary current when the short determination unit determines that a discharge-short has occurred; and the ignition control unit is configured to decrease, in the first step, the secondary current while keeping the secondary current higher than a predetermined lower current limit.

According to the ignition device of an internal combustion engine, the ignition control unit controls the secondary current adjusting unit to repeatedly perform the first step and the second step.

The first step decreases the amount of secondary current after the extension amount of the discharge spark becomes the predetermined extension amount, whereby the discharge spark is prevented from further extending and excessively swelling. Thus, since the configuration suppresses short of the discharge spark occurring at farther position from the discharge gap, caused by discharge spark being excessively extended, a positional change of the discharge spark can be suppressed so that ignitability of the air fuel mixture can be improved. Further, since the first step decreases the secondary current while keeping the secondary current higher than a predetermined lower current limit, blow-off of the discharge spark due to excessively low secondary current can readily be avoided.

Also, according to the second step, after the discharge spark short occurs, by increasing the secondary current, the extension amount of the discharge spark is likely to increase. Thus, the extension amount of the discharge spark can be secured so that the ignitability of the air fuel mixture can be improved. Then, the first step and the second step are repeatedly performed so that a change in the extension amount of the discharge spark can readily be reduced. Thus, the ignitability of air fuel mixture can be prevented from degradation due to variation of heating points of the air fuel mixture caused by a variation of the length of the discharge.

As described, according to aspects of the present disclosure, an ignition device of an internal combustion engine capable of improving the ignitability can be provided. Note that, the reference numerals in parentheses described in the claims and the means for solving the problems indicate the corresponding relationship between the specific means described in the following embodiments, and do not limit the technical range of the present invention.

DETAILED DESCRIPTION OF PREFERRED EMBODIMENTS

First Embodiment

With reference to FIGS. 1 to 9, embodiments of an ignition device of an internal combustion engine will be described.

Figure 6:
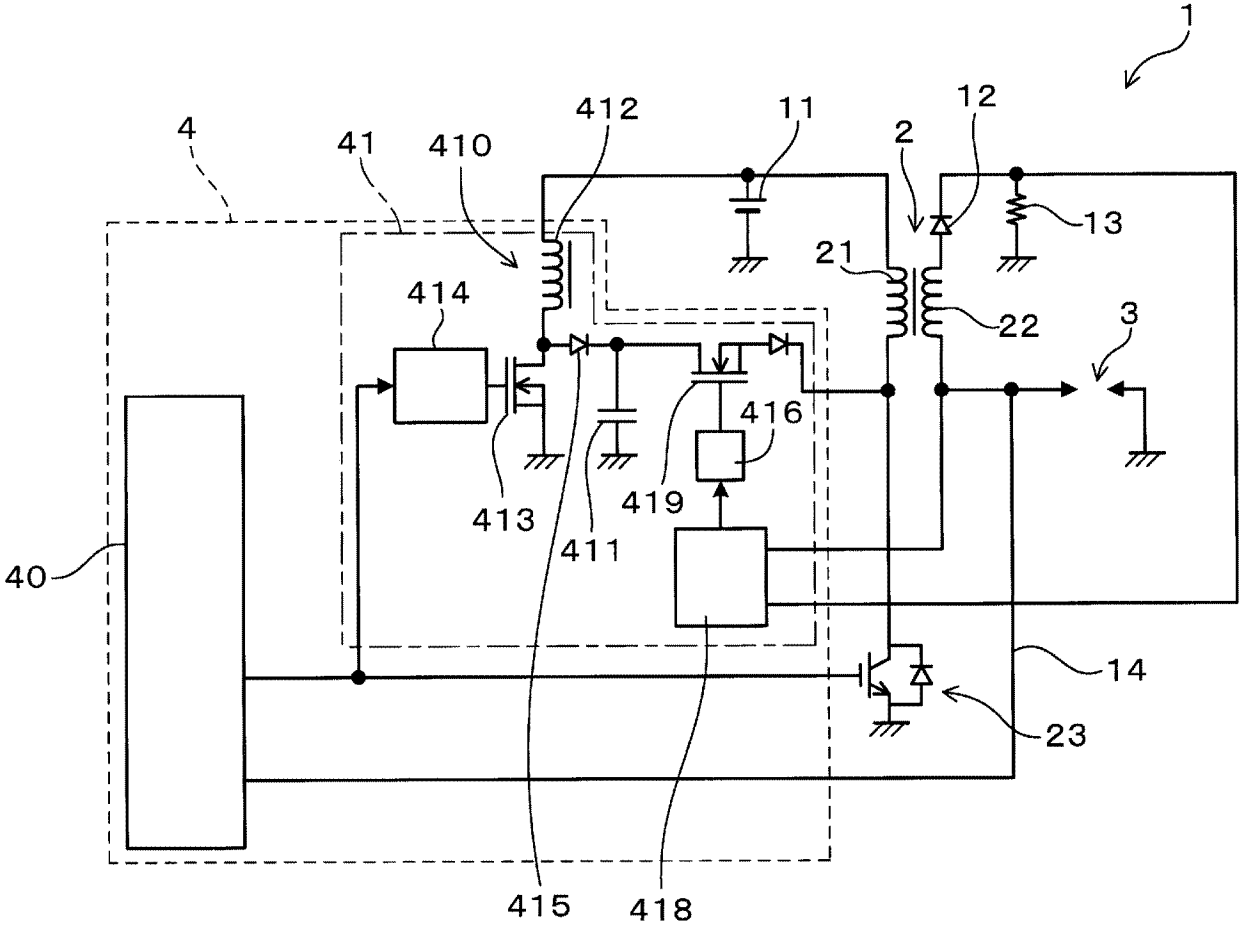
FIG. 6 is a circuit diagram of an ignition device of an internal combustion engine according to the first embodiment.

As shown in FIG. 6, an ignition device 2 of an internal combustion engine according to the first embodiment includes an ignition coil 2, an ignition plug 3 and an ignition control unit 4. The ignition coil 2 includes a primary coil 21, a secondary coil 22 at which a secondary current is produced with a change in the primary current. The ignition plug 3 is applied with the secondary voltage produced at the secondary coil 22, thereby producing a discharge. The ignition control unit 4 controls an ignition operation of the ignition plug 3.

The ignition control unit 4 includes a secondary voltage detecting unit that detects the secondary voltage. The ignition control unit 4 includes a secondary current adjusting unit 41 that adjusts, in each cycle, an amount of secondary current after initiating the discharge. Also, the ignition control unit 4 includes a discharge extension detecting unit that detects an amount of extension of discharge. Moreover, the ignition control unit 4 includes a short determination unit that determines whether a discharge-short (short of the discharge) has occurred based on the secondary voltage detected by the secondary voltage detecting unit.

Figure 1:
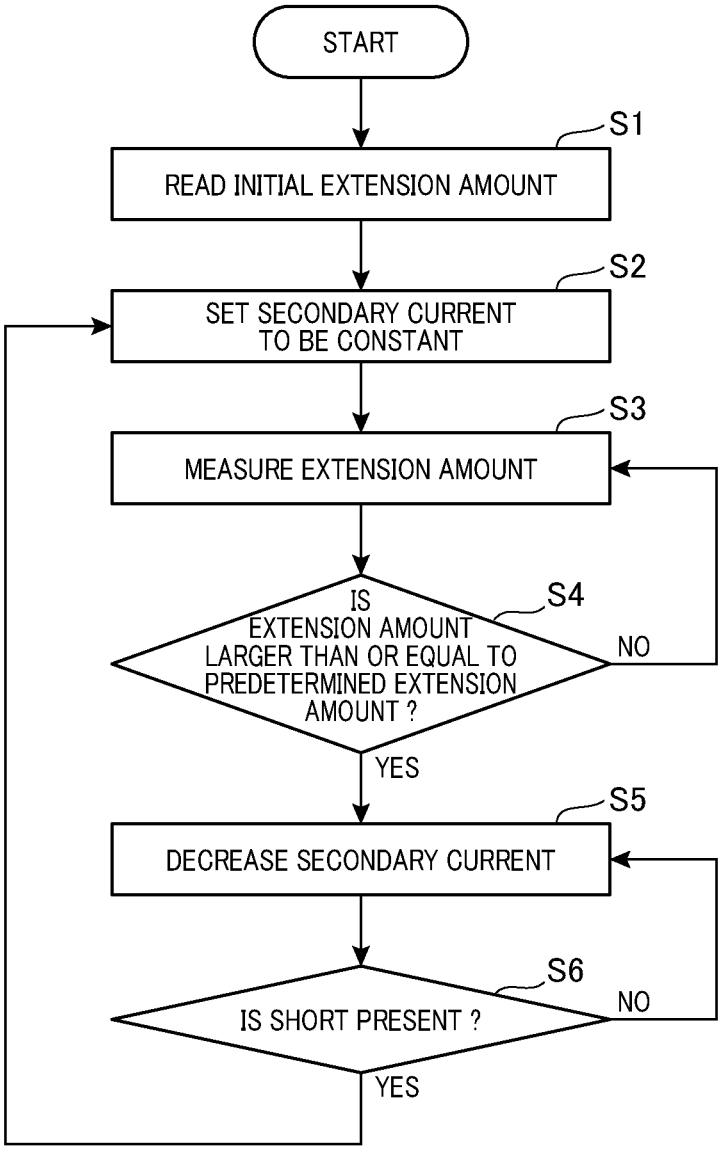
FIG. 1 is a flowchart showing control performed by an ignition control unit according to a first embodiment of the present disclosure.

As shown in FIG. 1, the ignition control unit 4 controls, in each cycle, the secondary current control unit such that a first step and a second step (described later) are repeatedly executed. In the first step (steps S4 to S5 shown in FIG. 1), the process decreases the secondary current when the extension amount detected by the discharge extension detecting unit is a predetermined extension amount or more. At this time, the ignition control unit decreases, at the first step, the secondary current while keeping the secondary current higher than a predetermined lower current limit. In the second step (steps S6 to S2 shown in FIG. 2), the process increases the secondary current when the short determination unit determines that discharge-short has occurred. Hereinafter, the ignition device 1 according to the first embodiment will be described in detail.

The ignition device 1 is used for an igniting means for air fuel mixture in an internal combustion engine. First, a basic structure of the ignition device 1 will be described.

As shown in FIG. 6, the ignition coil 6 has a primary coil and a secondary coil 22 which are magnetically coupled. The one end of the secondary coil 22 of the ignition coil 2 is electrically connected to the ignition plug 3.

Figure 2:
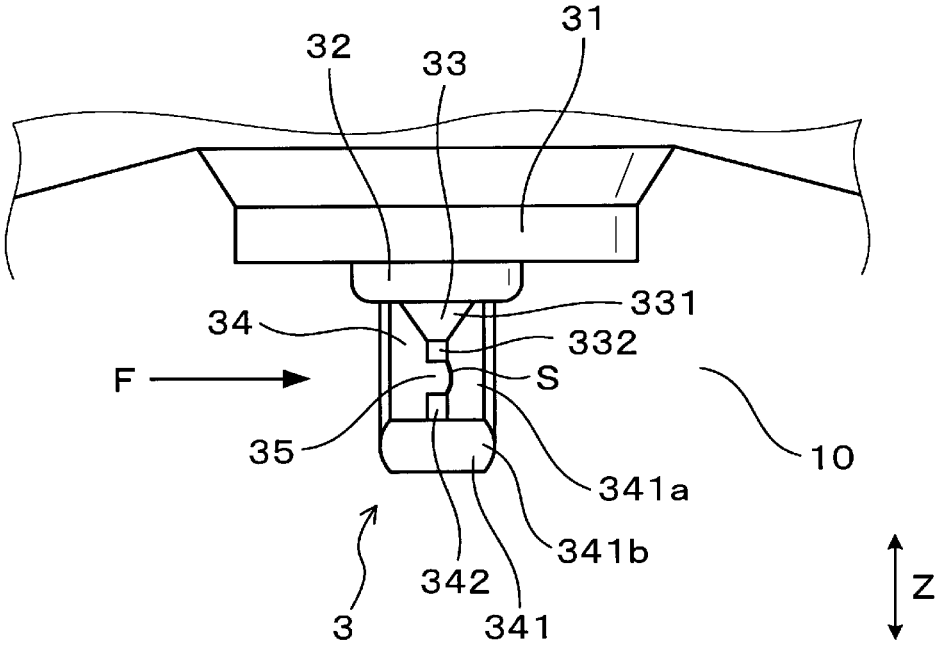
FIG. 2 is an enlarged front view of a vicinity of a tip end portion of an ignition plug, illustrating a state where an initial discharge spark is formed according to the first embodiment.
Figure 3:
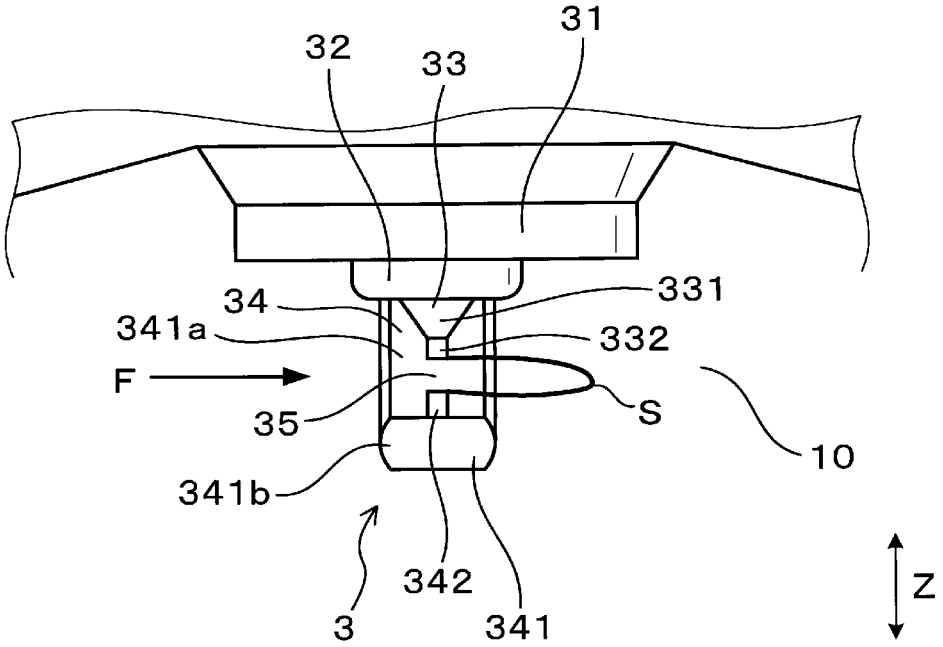
FIG. 3 is an enlarged front view of the tip end portion of the ignition plug, illustrating a state where the initial discharge spark is extended according to the first embodiment.
Figure 4:
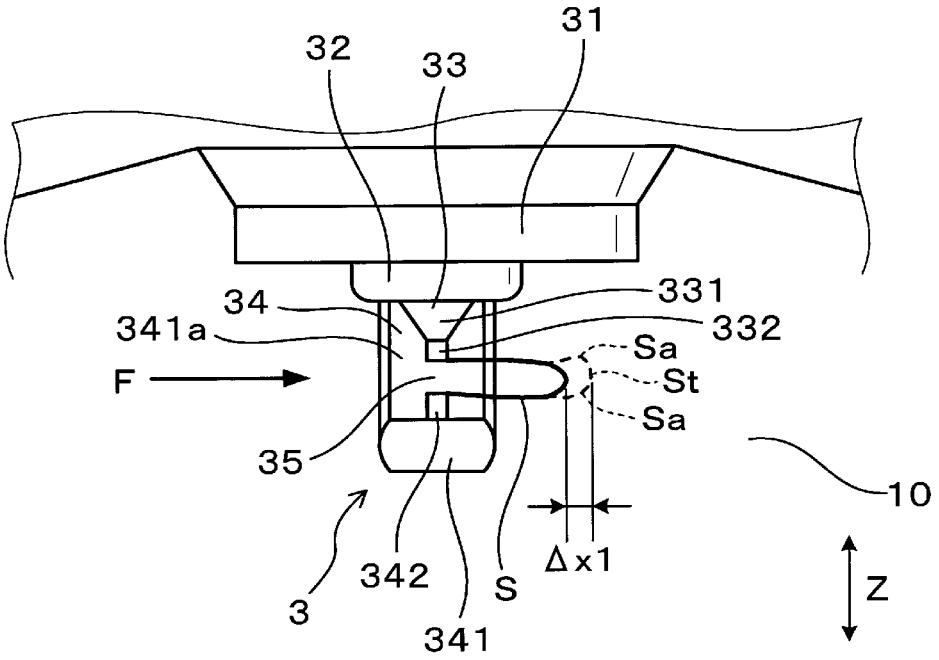
FIG. 4 is an enlarged front view of the tip end portion of the ignition plug, illustrating a positional change of the tip end of the discharge spark when the discharge spark is shorted, according to the first embodiment.

As shown in FIGS. 2 to 4, the ignition plug 3 is attached to the internal combustion engine such that the tip end portion of the ignition plug 3 is exposed to the combustion chamber 10. Hereinafter, the axial direction of the ignition plug 3 is defined as a plug axial direction Z. Also, a tip end side and a base end side with respect to the plug axial direction Z are defined. The tip end side is a side in which the ignition plug 3 is inserted into the combustion chamber 10 and the opposite side thereof is referred to as the base end side.

The ignition plug 3 includes a housing 31 having a cylindrical shape, an insulator 32 supported inside the housing 31, a center electrode 33 inserted and disposed in the insulator 32, and a ground electrode 34 that faces the center electrode 33 in the plug axial direction Z. A discharge gap 35 is formed between the center electrode 33 and the ground electrode 34 in the plug axial direction Z.

The center electrode 33 includes a center base 331 and a center chip 332. A tip end portion of the center base 331 is exposed to the tip end side of the insulator 32. The center chip 332 is disposed on a tip end face of the center base 331.

The ground electrode 34 includes a ground base 341 and a ground chip 342. The ground base 341 includes a standing portion 341*a* that stands from the housing 31 towards the plug axial direction Z and an inward portion 341*b* extending towards an inner periphery side from the tip end side of the standing portion 341*a*. The ground chip 342 is bonded to a portion in the inward portion 341*b*, facing the center chip 332 of the center electrode 33 in the plug axial direction Z.

Next, a control process of the ignition control unit 4 for controlling an ignition operation the ignition plug 3 will be described. First, the ignition control unit 4 cuts off conduction of power applied to the primary coil 21, whereby a high secondary voltage is produced at the secondary coil 22. Thus, as shown in FIG. 2, voltage is applied between the center electrode 3 of the ignition plug 3 electrically connected to the secondary coil 22 and the ground electrode 34 which is grounded so that discharge speak is generated at the discharge gap 35.

Figure 5:
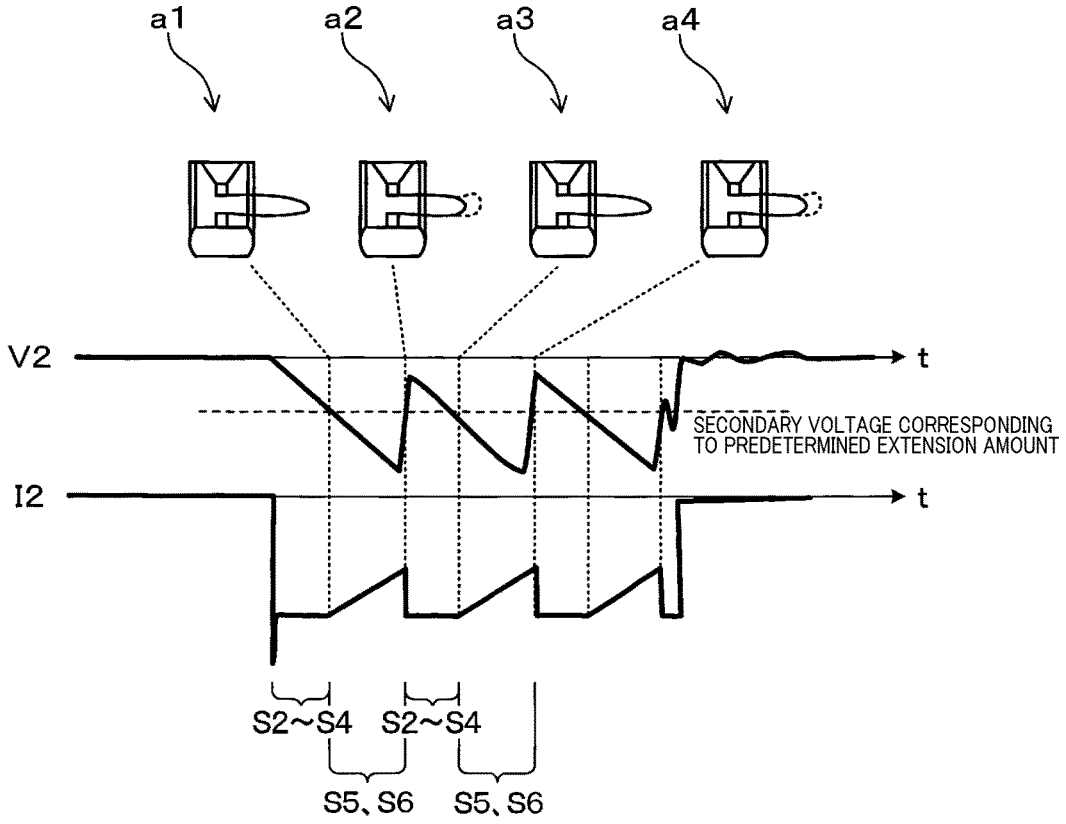
FIG. 5 is a diagram showing a relationship between the time and the secondary voltage, a relationship between the time and the secondary current, and a state of discharge spark at each time point according to the first embodiment.

As shown in FIG. 1, the ignition control unit 4 reads a preset initial extension amount at step S1. Then, as shown in FIGS. 1 and 5, at step S2, after initiating the discharge, the secondary current adjusting unit 41 of the ignition control unit 4 adjusts the secondary current I2 to be a constant current value. Thus, formation of the discharge spark is maintained. Here, as shown in FIGS. 2 and 3, the discharge spark S is extended towards the downstream side by the air stream of the air fuel mixture in the combustion chamber 10.

Figure 7:
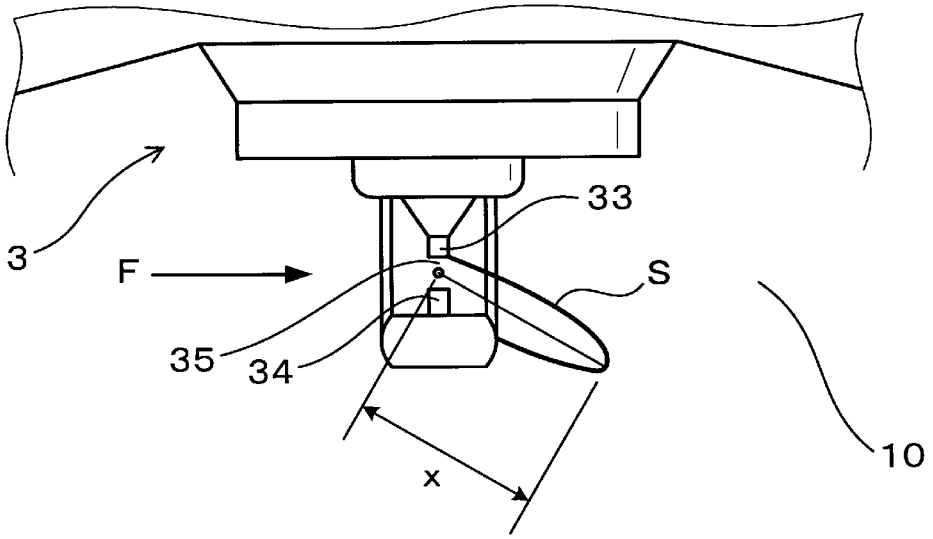
FIG. 7 is an enlarged front view of a tip end portion of an ignition plug, illustrating an amount of extension of a discharge spark according to the first embodiment.
Figure 8:
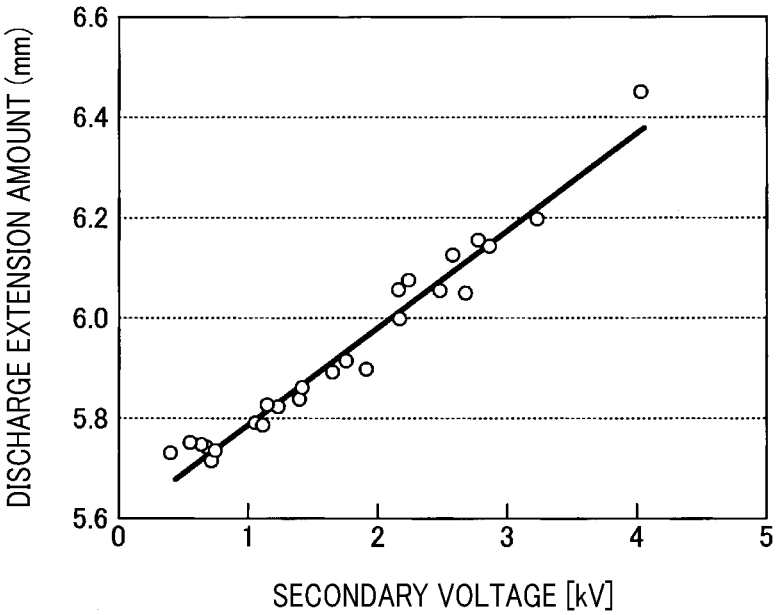
FIG. 8 is a graph showing a relationship between the secondary voltage and the discharge spark according to the first embodiment.

Then, as shown in FIG. 1, at step S3, the discharge extension detecting unit detects an amount of extension x of the discharge spark. Here, while discharge is formed in the ignition plug 3, the ignition control unit 4 detects a secondary voltage value V2, and the discharge extension detecting unit of the ignition control unit 4 calculates an amount of extension of the discharge spark based on the secondary voltage value V2. As shown in FIG. 7, the amount of extension x of the discharge spark is defined as a maximum length between the center of the discharge gap 35 in the plug axial direction Z and the discharge spark S. As shown in FIG. 8, the discharge extension detecting unit utilizes characteristics that the secondary voltage value V2 is proportional to the amount of extension x of the discharge spark S and calculates the amount of extension of the discharge spark based on the secondary voltage value V2.

As shown in FIG. 1, at step S4, the process determines whether the amount of extension of the discharge spark detected by the discharge extension detecting unit is a predetermined extension amount. When it is determined that the amount of extension is less than the predetermined extension amount, the process returns to step S3. On the other hand, as shown in FIGS. 1 and 5, when it is determined that the amount of extension of the discharge spark is predetermined extension amount or more, the ignition control unit 4 controls the secondary current adjusting unit 41 to gradually decease the secondary current I2. Processes from step S4 to step S5 correspond to the above-described first step. Note that the ignition control unit 4 controls the secondary current value to be larger than the predetermined lower current limit. In FIG. 5, portions indicated by symbols a1 and a3 illustrate a state of discharge spark where the amount of extension of the discharge spark becomes the predetermined extension amount.

The step S6 is executed after the step S5. In step S6, the short determination unit of the ignition control unit 4 determines whether or not a discharge short has occurred. As shown in FIG. 5, when the discharge short occurs, the secondary voltage V2 rapidly decreases. This is because, the discharge is shorted so that length of the discharge pass rapidly becomes shorter and resistance of the conduction path including the discharge rapidly decreases. Then, the short determination unit determines that a discharge short has occurred when the secondary voltage V2 rapidly increases. In FIG. 4, a discharge spark S immediately after the short is indicated by a solid line, and a discharge spark S immediately before the short is indicated by a dotted line. Also, in FIG. 5, as shown in portions indicated by symbols a2 and a4, a discharge spark immediately after the short is indicated by a solid line, and a discharge spark immediately before the short is indicated by a dotted line. Diagrams indicated by symbols a2 and a4 are the same as those of FIG. 4. The discharge short refers to a short that conducts a part of the discharge path and another part of the discharge path.

As shown in FIG. 1, when the short determination unit determines occurrence of discharge short, the process returns to step S2. In other words, the process stops decreasing secondary current and increases the secondary current to be constant value. The processes from step S6 to step S2 corresponds to the above-described second step. When the process determines that no discharge short has occurred, the process returns to step S5. The above-described processes (controls) are repeated at every cycle.

Next, with reference to FIG. 6, a circuit configuration of an ignition device 1 according to the present embodiment will be described. The ignition control unit 4 includes an engine control unit (hereinafter referred to as ECU 40). An operational state of the internal combustion engine is controlled by the ECU 40. The ECU 40 controls each part of the engine to optimize the combustion state of the engine, based on an operational state of the engine determined by engine parameters acquired from various sensors. The ECU 40 constitutes the ignition control unit 4.

The ignition coil 2 includes a primary coil 21, a secondary coil 22, and an ignitor 23. One end of the first coil 21 is electrically connected to the positive side of the battery 11, and the other end is grounded via an ignitor 23 which will be described later. The ignition coil 2 is configured such that primary current flows through the primary coil 21 when the ignitor 23 is ON. Hereinafter, the direction where the primary current flows, that is, direction from the battery 11 to the primary coil 21 is defined as positive. The circuit is configured such that high secondary voltage is generated at the secondary coil 22 by cutting off positive-side primary current to the primary coil 21.

One end of the secondary coil 22 is connected to the ignition plug 3, and the other end of the secondary coil 22 is grounded via a diode 12 and a shunt resistor 13. The diode 12 limits the flow direction of the secondary current to be a direction from the ignition plug 3 to the secondary coil 22. The anode side of the diode 12 is connected to the secondary coil 22. A secondary voltage detection circuit 14 is connected between the secondary coil 22 and the ignition plug 3. The secondary voltage detection circuit 13 transmits information of the secondary voltage to the ECU 40. Thus, according to the present embodiment, the secondary voltage detecting unit measures the voltage at the secondary coil 22, thereby acquiring secondary voltage value.

The ignitor 23 includes a switching element such as IGBT (insulated gate bipolar transistor). The ignitor 23 is connected to the primary coil 21 at the collector side thereof and is grounded at the emitter side thereof. The ignitor 23 performs a switching operation based on a signal at the gate thereof.

The secondary current adjusting unit 41 is disposed in parallel to the primary coil 21 and connected to the battery 11. The secondary current adjusting unit 41 is configured to allow primary current to flow through the primary coil 21 in the negative direction. The secondary current adjusting unit 41 includes a boost circuit 410, an auxiliary switch 419, an auxiliary driver 416 and an auxiliary diode 417. The secondary current adjusting unit 41 is configured such that the boost circuit 410 boosts the voltage of the battery 11 and accumulates the boosted voltage in a capacitor 411, and the accumulated energy is put into the ground side of the primary coil 21. The ignition device 1 applies the secondary voltage generated in the secondary coil 22 to the ignition plug 3, thereby discharging the secondary voltage. Further, during the discharging period, the secondary current flowing through the secondary coil 22 can be increased by supplying more energy.

The boost circuit 410 includes a choke coil 412, a boost switch 413, a boost driver 414, a boost diode 415 and a boost capacitor 411. The boost circuit 410 is configured to boost the voltage of the battery 11 and charge the capacitor 411 with the boosted voltage, while the ECU 40 supplies high level ignition signal IGt to the boost circuit.

The choke coil 412 is connected to the battery 11 at one end side, and the other side of the choke coil is grounded via the boost switch 413. The boost switch 413 includes a MOSFET (i.e., field effect transistor). The boost switch 413 is connected to the choke coil 412, and the source is grounded. The boost switch 413 operates (i.e., switching operation) in accordance with a signal transmitted from the boost driver 414 to the gate. The boost driver 414 is configured to switch the boost switch 413 between ON and OFF repeatedly at a predetermined period. Current flows through the coil 412 when the boost switch 413 is ON, thereby accumulating energy in the coil 412. The anode of the boost diode 415 is connected between the choke coil 412 and the boost switch 413, and the cathode is connected to the capacitor 411. The capacitor 411 is grounded at the opposite end with respect to the boost diode 415. The capacitor 411 accumulates energy when both of the boost switch 413 and the auxiliary switch 419 are OFF.

The auxiliary switch 419 includes a MOSFET. The drain of the auxiliary switch 419 is connected to a connection point between the boost diode 415 and the capacitor 411, and the source of the auxiliary switch 419 is connected to a connection point between the primary coil 21 and the ignitor 23 via the auxiliary diode 417. The auxiliary switch 419 allows current to flow from the secondary current adjustment unit 41 to the primary coil 21 side, when the auxiliary switch 419 is ON, and cuts off current flowing from the secondary current adjustment unit 41 to the primary coil 21 side. The auxiliary switch 419 performs switching operation in accordance with the signal transmitted from the auxiliary driver 416 to the gate.

The auxiliary driver 416 is configured to drive the auxiliary switch 419 to be ON and OFF at a predetermined period, while high level discharge continuation signal IGw is received from a signal generation unit 418. Thus, the secondary current adjustment unit 41 allows current to flow through the primary coil 21 in the negative direction. The signal generation unit 418 is configured to acquire information of the secondary current and the secondary voltage. The signal generation unit 418 generates the discharge continuation signal IGw based on the acquired information.

Next, effects and advantages of the present embodiments will be described. In the ignition device 1 of an internal combustion engine of the present embodiment, the ignition control unit 4 performs the first step when the extension amount detected by the discharge extension detecting unit is a predetermined extension amount or more, such that an amount of secondary current is decreased to be within a range larger the predetermined lower current limit. Thus, the first step decreases the amount of secondary current after the extension amount of the discharge spark becomes the predetermined extension amount, whereby the discharge spark is prevented from further extending and excessively swelling. Thus, since the configuration suppresses shorting of the discharge spark occurring at a position farther from the discharge gap, caused by discharge spark being excessively extended, a positional change of the discharge spark can be suppressed so that ignitability of the air fuel mixture can be improved. Hereinafter, this case will be described in detail.

First, with reference to FIG. 9, unlike the present embodiment, a case will be described in which the discharge spark S is excessively extended to swell the spark itself. Note that the discharge spark S immediately before being blown off is indicated by a dotted line, and the discharge spark S immediately after a re-discharge is indicated by a solid line. A difference between the extension amount of the discharge spark S immediately before being blown off and the extension amount of the discharge spark S by the re-discharge is indicated by $\Delta\times2$.

Figure 9:
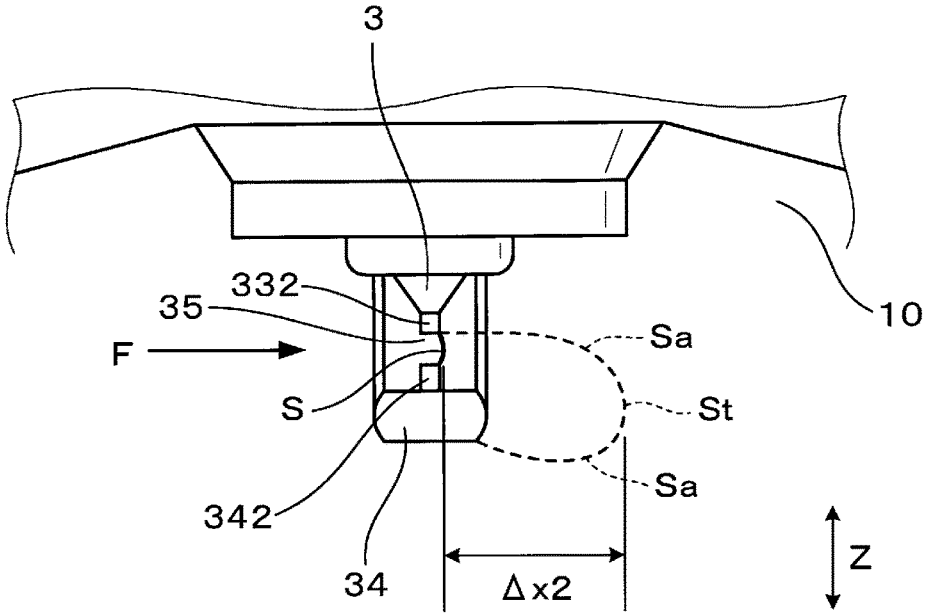
FIG. 9 is an enlarged front view of the tip end portion of the ignition plug, illustrating a positional change of the tip end of the discharge spark when the discharge spark is shorted according to a comparative embodiment.

As shown in FIG. 9, in the case where the end point of the discharge spark S in the ground electrode 34 side is moved by the air flow, whereby the discharge spark S is extended to be excessively swelled, the curvature at a folding portion St which is in the most downstream side of the discharge spark is unlikely to be larger. Hence, portions Sa adjacent to the folding portion are unlikely to be close so that these portions are unlikely to short. As a result, the discharge spark is excessively extended towards the downstream side until the blow-off.

Then, the discharge spark S excessively extended towards the downstream side will be soon blown-off so that re-discharge occurs between the center chip 332 of the center electrode 33 and the ground chip 342 of the ground electrode 34. Thereafter, extension of the portion between both end points of the discharge spark S, blow-off and re-discharge are repeated.

Thus, when the discharge spark is excessively extended towards the downstream side, blown-off of the discharge spark and a re-discharge are likely to occur. Therefore, as shown in FIG. 9, the above-mentioned difference $\Delta\times2$ are relatively large. In other words, an end portion in the downstream side of the discharge spark S is likely to vary. Hence, heat transfer cannot be performed effectively between the discharge spark S and air fuel mixture in the combustion chamber 10. As a result, ignitability of the air fuel mixture is difficult to be improved. Also, since re-discharge often occurs, the number of capacitive discharge during the initial discharge increases so that the electrodes are likely to be wore. Accordingly, the discharge gap 35 is likely to extend.

Next as shown in FIG. 4, the discharge spark S is extended towards downstream side according to the present embodiment. However, in the present embodiment, discharge spark S is controlled to avoid extension with excessively swelling towards downstream side. According to the present embodiment, the portion between both end points of the discharge spark S is sharply extended towards the downstream side. Thus, the curvature of the folding portion St of the discharge spark S becomes larger as the discharge spark S is extended towards the downstream side. Hence, when the portion between both end points of the discharge spark is extended, portions Sa adjacent to both sides of the folding portion St approaches to each other and will be shorted soon. Thereafter, extension of the discharge spark S and the short is repeated. Note that a difference between an extension amount of the discharge spark S immediately before short of the discharge spark S and an extension amount of the shorted discharge spark S is indicated by $\Delta\times1$ in FIG. 4.

Thus, the discharge spark S is prevented from being excessively extended towards the downstream side, positional change of the discharge spark S caused by occurrence of short can be suppressed so that the ignitability of the air fuel mixture can be improved. Therefore, ignitability of the air fuel mixture can be improved. Further, re-discharge is suppressed so that extension of the discharge gap 35 due to wear of the electrode can be suppressed.

Moreover, the ignition control unit 4, when the short determination unit determines occurrence of discharge short, executes the second step process that increases current of the secondary current. With this second step, after the discharge spark short occurs, by increasing the secondary current, the extension amount of the discharge spark S is likely to increase. Thus, extension amount of the discharge spark can be secured so that ignitability of air fuel mixture can be improved. Then, the first and second steps are repeated so that variation of the extension of the discharge speak can readily be suppressed. As a result, it can avoid degradation of the ignitability to the air fuel mixture when heating points of the air fuel mixture vary due to large variations of the discharge length.

The secondary voltage detecting unit measures voltage produced at the secondary coil 22 to acquire the secondary voltage value. That is, the secondary voltage detecting unit directly measures the secondary voltage to acquire the secondary voltage value. Hence, the secondary voltage value can be accurately acquired.

As described, according to the present embodiment, an ignition device of an internal combustion engine capable of readily improving the ignitability can be provided.

Experiment Example

Figure 10:
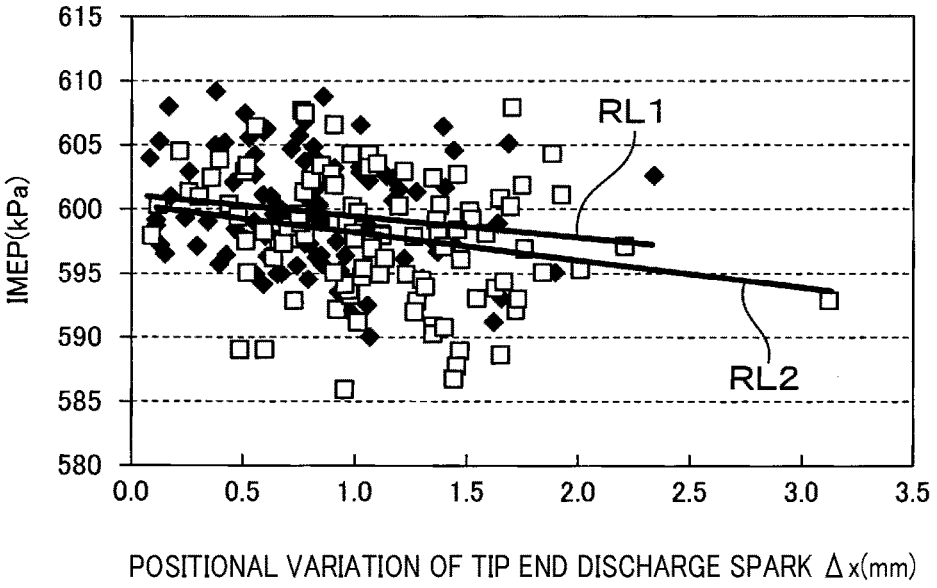
FIG. 10 is a graph showing a relationship between a positional variation $\Delta x$ of a tip end discharge spark and an indicated mean effective pressure (i.e., IMEP) according to an experiment example.

According to the present example, as shown in FIG. 10, a relationship between a positional variation of a tip end discharge spark and an indicated mean effective pressure (i.e., IMEP) is evaluated for the ignition device 1 of the first embodiment (referred to as a test device 1 in this example) and an ignition device 1 with a control of the first embodiment (referred to as a test device 2 in this example). The test device 1 performs a control in which the step 1 and step 2 are repeatedly executed, and the test device 2 does not include the control in which the step 1 and step 2 are repeatedly executed. The same controls are performed between the test device 1 and the test device 2 except the above-described control in which the step 1 and step 2 are repeatedly executed. Here, the positional variation of a tip end discharge spark refers to a difference between the extension amount of discharge spark immediately before the short of the discharge spark and the extension amount of discharge spark immediately after the short of the of discharge spark, which corresponds to $\Delta\times1$ or $\Delta\times2$ according to the first embodiment. The indicated mean effective pressure represents a degree of ignitability such that the higher the value, the better the ignitability is.

In FIG. 10, test result of the test device 1 is indicated by a diamond shape plot, and the test result of the test device 2 is indicated by a white quadrable plot. A regression line of the test result for the test device 1 is indicated by RL1, and a regression line of the test result for the test device 2 is indicated by RL2.

The same test condition was used for both ignition devices 1. Specifically, both ignition devices 1 were mounted to 2.5 liter engine and the engine rotation frequency was 120 rpm and A/F (air fuel ratio) was 27.0. The test result is shown in FIG. 10.

As shown in FIG. 10, according to the test result for the test device 1, the positional variation of a tip end discharge spark is suppressed compared to the test result of the test device 2. Specifically, it is understood that the positional variation of a tip end discharge spark is suppressed by repeatedly performing the processes of steps 1 and 2. Further, according to the test result of the test device 1, IMEP is improved compared to the result of the test device 2. In other words, by repeatedly performing the control processes of steps 1 and 2, ignitability is improved.

Second Embodiment

Figure 11:
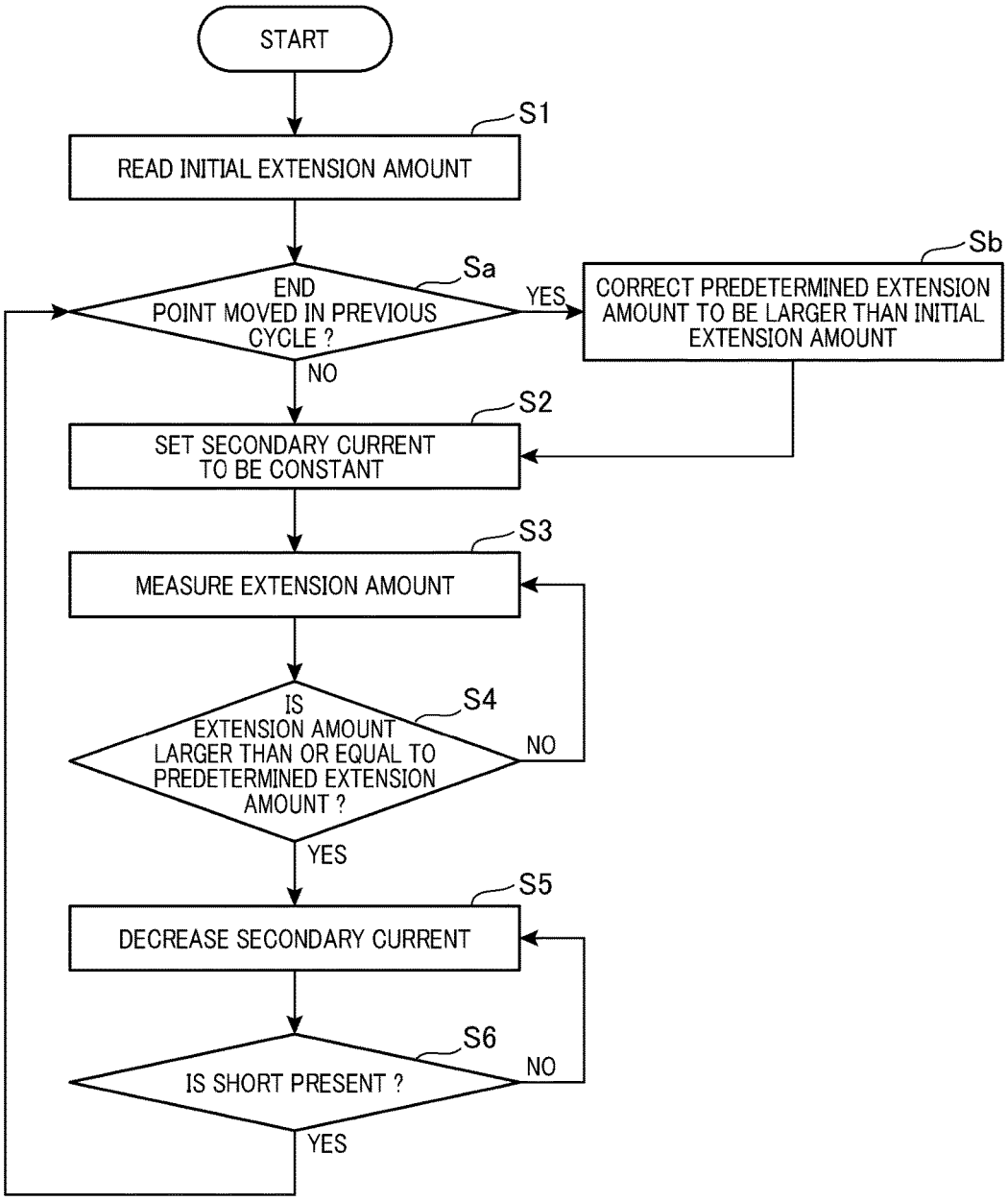
FIG. 11 is a flowchart illustrating a control performed by an ignition control unit according to a second embodiment.
Figure 12:
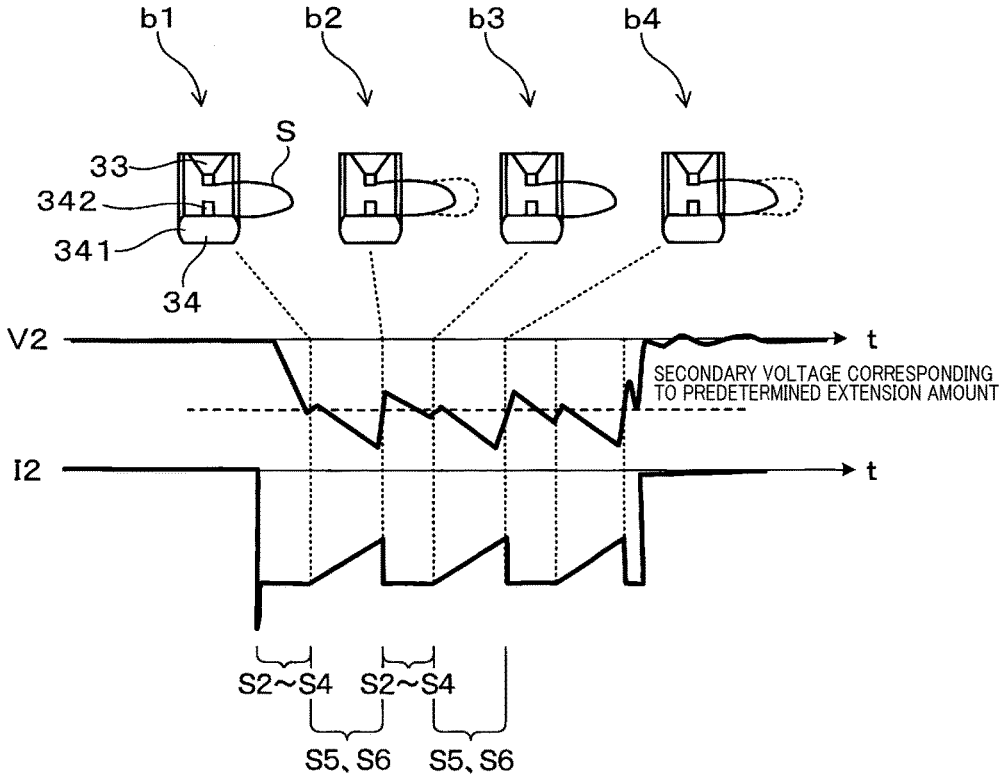
FIG. 12 is a diagram showing a relationship between the time and the secondary voltage, a relationship between the time and the secondary current, and a state of discharge spark at each time point according to the second embodiment.

According to the second embodiment, as shown in FIGS. 11 and 12, basic configuration is the same as that of the first embodiment, but the ignition control unit 4 further includes an end point movement determination unit that determines, based on an acquisition result of the secondary voltage by the secondary voltage detecting unit, whether the end point of the discharge moves from a chip (i.e., center chip 332, ground chip 342) to the base (i.e., center base 331, ground base 341). The ignition control unit 4 corrects, in each cycle, the predetermined extension amount, based on the determination result of the end point movement determination unit. In FIG. 12, portions indicated by symbol b1 and symbol b3 illustrate states of the discharge spark when the extension amount reaches the predetermined extension amount. Also, portions indicated by symbol b2 and symbol b4 illustrate a discharge spark immediately after occurrence of short with a solid line, and a discharge spark immediately before occurrence of a short with a dotted line.

First, as shown in FIG. 11, similar to the first embodiment, the process reads preset initial extension amount at step S1. Then, according to the second embodiment, at step Sa, the end point movement determination unit determines whether the end point of the discharge spark in the previous cycle moves to the ground base 341 from the ground chip 342. As shown in FIG. 12, since the discharge path immediately after the end point moves is shorter than the discharge path immediately before the end point moves, the secondary voltage V2 momentarily drops. When detecting this momentary drop of the secondary voltage V2, the process determines that the end point of the discharge spark moved.

Next, at step Sa, when determining the end point moved in the previous cycle, the process increases the predetermined extension amount to be larger than the initial value and proceeds to step S2. On the other hand, at step Sa, when determining that no movement of the end point is present in the previous cycle, the process proceeds to step S2 without any processing. Hereinafter, similar to the first embodiment, process from step S2 to step S6 will be executed. Here, at step S6, when determining that the short has occurred, the process returns to step Sa.

Other part of configurations are the same as that of the first embodiment. Note that in the second embodiment, elements having the same reference number as those of the previous embodiment represent the same elements of the previous embodiment unless otherwise specified.

In the second embodiment, position of the downstream side (i.e., extended portion) of the discharge spark can readily be maintained at a portion apart from the discharge gap 35. In other words, when the end point of the discharge spark is moved, the length in the plug axial direction Z becomes large. Hence, even when the discharge spark is significantly extended towards the downstream side, the discharge spark is likely to extend sharply and is unlikely to extend to significantly swell. Hence, according to the present embodiment, the discharge gap is repeatedly extended and swelled at a portion apart from the discharge gap 35. Accordingly, the initial flame produced by igniting the air fuel mixture via the discharge spark can be positioned away from the discharge gap 35 so that the initial spark can readily be prevented from being removed by a cooling action in which the electrode absorbs heat of the flame. Other than this, the same effects and advantages as the first embodiment can be obtained.

Third Embodiment

Figure 13:
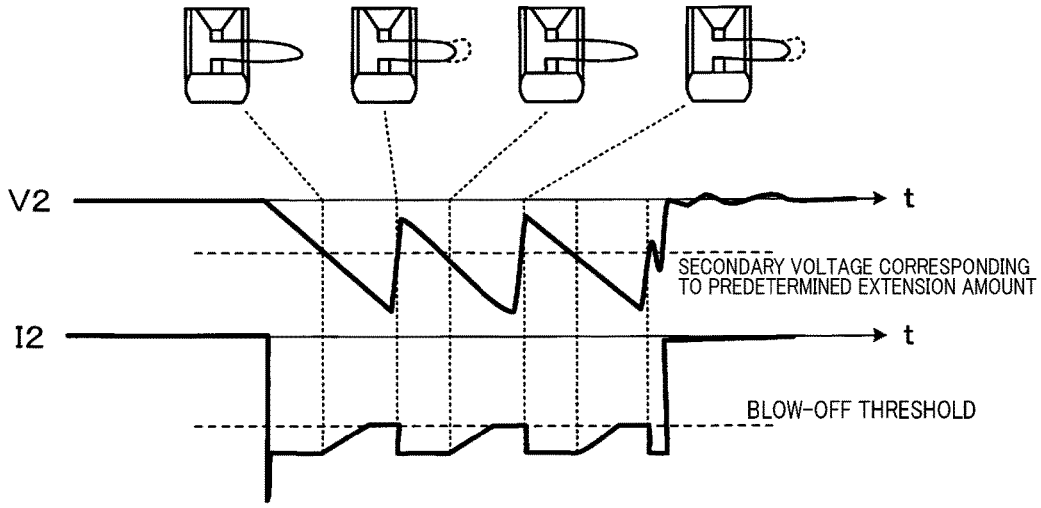
FIG. 13 is a diagram showing a relationship between the time and the secondary voltage, a relationship between the time and the secondary current, and a state of discharge spark at each time point according to a third embodiment.

As shown in FIG. 13, the third embodiment has the same basic configuration as that of the first embodiment, and the lower limit current value is set to be a blow-off threshold defined as a minimum value of the secondary current which causes no blow-off of the discharge. The blow-off threshold is calculated based on the operation condition of the internal combustion engine and a shape of the ignition plug 3 and with reference to a map stored in advance. For example, as shown in FIG. 13, in the case where the secondary current I2 is about to reach the blow-off threshold when the process decreases the secondary current I2 at step S5, the process stops to decrease the secondary current I2 and maintains the secondary current I2 to be larger than the blow-off threshold. Other configurations are the same as those of the first embodiment.

According to the present embodiment, occurrence of blow-off of the discharge spark is avoided more easily. Other than this, the same effects and advantages as the first embodiment can be obtained.

Fourth Embodiment

The basic configuration of the fourth embodiment is the same as that of the first embodiment. The fourth embodiment includes a newly added control in which the ignition control unit 4 controls the secondary current adjusting unit 41. According to the fourth embodiment, similar to the second embodiment, the ignition control unit 4 includes an end point movement determination unit. In the present embodiment, the ignition control unit 4 controls the secondary current adjusting unit 41 such that an ignition energy supplied to the ignition plug 3 is a predetermined upper limit energy or less, when the end point movement determination unit determines in each cycle that the end point of the discharge spark has moved. The upper limit energy is set to be a value in which the energy supplied to the ignition plug 3 from the ignition coil 2 does not exceed an ignition energy (hereinafter sometimes referred to as required energy) required for igniting the air fuel mixture in each cycle. The required energy is calculated based on an operation state determined by engine parameters acquired from various sensors, for example.

The ignition control unit 4 lowers the secondary current, when movement of the end point is detected in a cycle, such that the ignition energy becomes the upper limit energy or less in the next cycle. Note that the ignition energy is defined as a product of the secondary current value, the secondary voltage value and the discharge time. Other part of configurations are the same as that of the first embodiment.

According to the present embodiment, the ignition energy in each cycle can readily be prevented from being excessively larger. In other words, when the end point of the discharge spark occurs, the discharge spark extends so that contact area between the discharge spark and the air fuel mixture becomes larger. Hence, required energy becomes relatively small. Therefore, according to the present embodiment, when the end point of the discharge spark is detected, by controlling the ignition energy supplied to the ignition plug 3 to be the upper limit energy or less, waste of energy consumption can be reduced. Other than this, the same effects and advantages as the first embodiment can be obtained.

Fifth Embodiment

According to the fifth embodiment, the ignition control unit 4 corrects the lower current limit such that an energy to be supplied to the ignition plug 3 is controlled to be a predetermined lower limit energy or more. The lower limit energy is set to be slightly larger than the required energy for each cycle which is calculated based on an operation state determined by engine parameters acquired from various sensors. The ignition control unit 4 corrects the lower limit current value to be larger than the initial value when the required energy for each cycle is relatively high. Other configurations are the same as those of the first embodiment.

According to the present embodiment, the ignition energy can be maintained at the required energy for each cycle or more. Thus, an ignitability of the air fuel mixture can be improved as well with the configuration of the present embodiment. Other than this, the same effects and advantages as the first embodiment can be obtained.

Sixth Embodiment

According to the sixth embodiment, the secondary voltage detecting unit is modified from those of the first to fifth embodiments. According to the present embodiment, the secondary voltage detecting unit measures the primary voltage which is correlated to the secondary voltage and calculates the secondary voltage based on the measured primary voltage.

Figure 14:
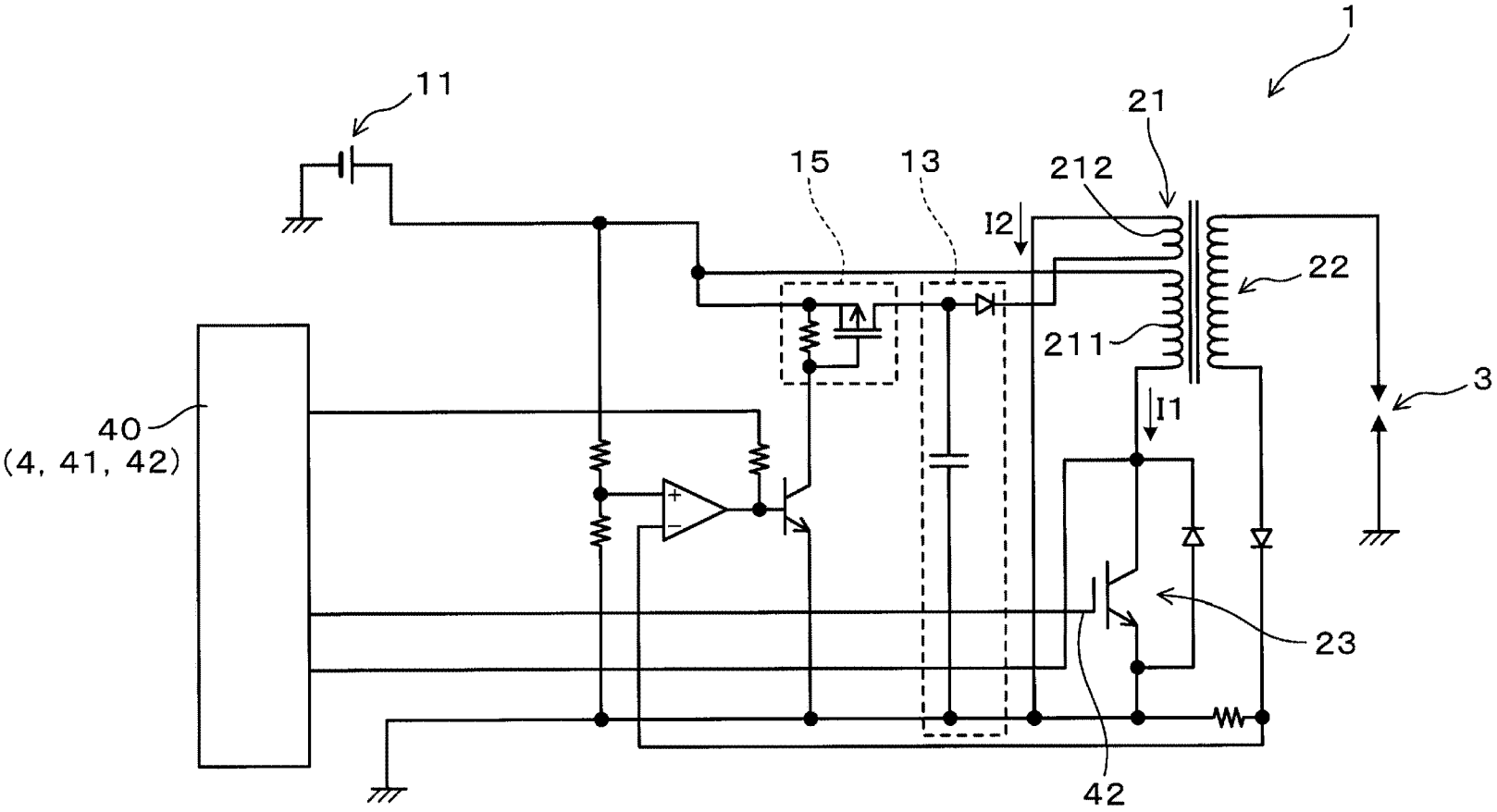
FIG. 14 is a circuit diagram showing an ignition device of an internal combustion engine according to a sixth embodiment.
Figure 15:
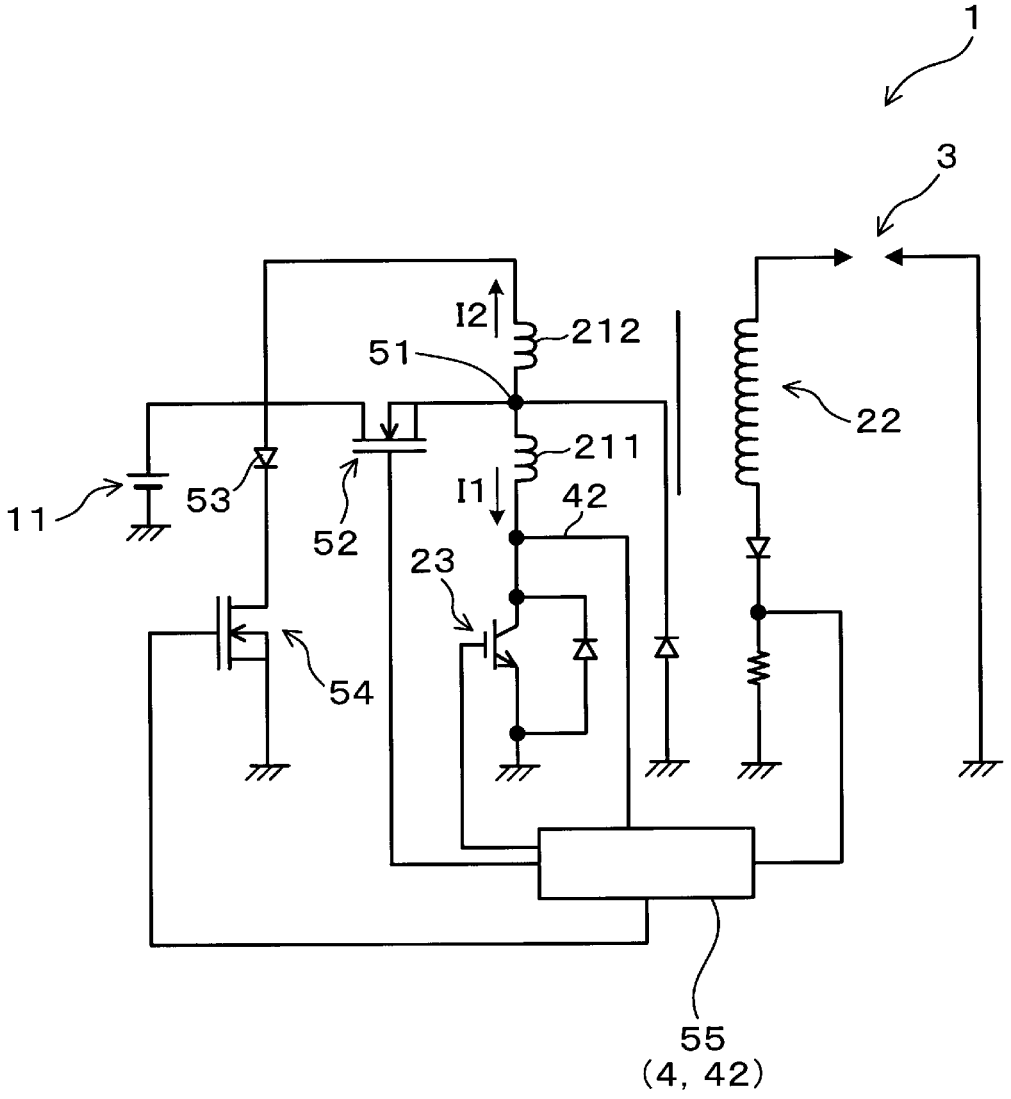
FIG. 15 is a circuit diagram showing an ignition device of an internal combustion engine according to a seventh embodiment.

As shown in FIG. 14, the primary coil 21 includes a main primary coil 211 and a sub primary coil 212 which are connected in parallel to the battery 11. The ignition control unit 4 includes a main primary voltage measuring unit 42 that measures voltage of the main primary coil 211. The secondary current adjusting unit 41 adjusts the current flowing through the sub primary coil 212, thereby adjusting the amount of the secondary current. The secondary voltage detecting unit is configured to calculate, after initiating the discharge, the secondary voltage value based on the voltage at the main primary coil 211 which is measured by the main primary voltage measuring unit 42.

One end of the main primary coil 211 is connected to the battery 11, and the other end is grounded via the ignitor 23.

One end of the sub primary coil 212 is connected to the battery 11 via a superimposed current stabilizing means 13 and a sub switch 15. The superimposed current stabilizing means 13 suppresses a rapidly cutting-off of the power being supplied to the sub primary coil 12 when the sub switch 15 turns OFF. In other words, the superimposed current stabilizing means 13 includes a function that gradually reduces the superimposed current of the sub primary coil 212. The other end of the sub primary coil 212 is grounded. The number of winding of the sub primary coil 212 is smaller than that of the main primary coil 211. The sub switch 15 is controlled by the ECU 40 to perform switching operation.

According to the ignition device 1 of the present embodiment, the ignitor 23 and the sub switch 15 are controlled to be ON and OFF respectively, whereby a main primary current I1 flows through the main primary coil 211. Then, after predetermined period elapses, by controlling the ignitor 34 to be OFF from ON state, the main primary current I1 that flows through the main primary current 211 is cut off so that the secondary voltage is generated at the secondary coil 22 to cause a discharge in the ignition plug 3.

Then, after the cutoff timing at which the power supplied to the main primary coil 211 is cut off, by turning the sub switch 15 to be ON, the sub primary current I2 flows through the sub primary coil 212. Thus, the discharge energy generated at the secondary coil 22 increases. Hence, a switching operation of the sub switch 15 is performed after the cutoff timing, whereby the discharge energy can be increased by superposing it.

The above-described main primary voltage measuring unit 42 is connected between the main primary coil 211 and the ignitor 23. The main voltage measuring unit 42 transmits the main primary voltage value to the ECU 40. The secondary voltage detecting unit calculates, in each cycle, calculates a secondary voltage value of the secondary coil from the voltage value of the main primary coil, based on the correlation between the voltage at the main primary coil 211 and the voltage at the secondary coil 22 after starting discharge. Note that other parts of the configuration are the same as those disclosed in the international publication No. 2017/969935 so that detailed explanation will be omitted. In the present embodiment, similar controls to the first to fifth embodiments are performed.

According ton the present embodiment, voltage at the primary voltage side which is of a relatively low voltage is measured, whereby the secondary voltage value can be indirectly acquired. Thus, compared to a direct measurement of the secondary voltage, according to the present embodiment, a control circuit to detect the secondary voltage can be designed with low voltage circuit. Hence, a small and low cost ignition device 1 can be achieved. Other than this, the same effects and advantages as the first to fifth embodiments can be obtained.

Seventh Embodiment

Similar to the sixth embodiment, according to the seventh embodiment, the secondary voltage detecting unit measures the primary voltage which is correlated to the secondary voltage value, and then calculates the secondary voltage based on the measured primary voltage, thereby acquiring the secondary voltage value.

The seventh embodiment also includes a major primary coil 211 and a sub primary coil 212 which are connected in parallel to the battery 11. The major primary coil 211 and the sub primary coil 212 are connected in series. An intermediate tap 51 is provided between the main primary coil 21 and the sub primary coil 212. The intermediate tap 51 is connected to the battery 11 via a primary side switching element 52. The primary side switching element 52 is composed of MOSFET (metal oxide semiconductor field effect transistor), and performs a switching operation in response to the signal applied to the gate terminal. When the primary side switching element is closed, a predetermined voltage is applied to the intermediate tap 51 from the battery 11.

An opposite side of the intermediate tap 51 in the main primary coil 211 is grounded via the ignitor 23.

An opposite side of the intermediate tap 51 in the sub primary coil 212 is connected to the ground via the diode 53 and the sub switching element 54. The diode 533 is connected to the sub primary coil 212 at the anode thereof. The sub switching element 54 is composed of MOSFET, and performs a switching operation in response to the signal applied to the gate terminal thereof. The primary side switching element 52, the sub switching element 54 and the gate of the ignitor 23 is connected to an ignition control circuit 55 that receives an ignition signal transmitted from the ECU 40.

In the ignition device 1 according to the present embodiment, the primary side switching element 52 and the ignitor 23 are controlled to be ON and the sub switching element 54 is controlled to be OFF, whereby the main primary current I1 flows through the main primary coil 211. After a predetermined period elapses, the ignitor 23 is controlled to be OFF from ON state, thereby cutting off the main primary current I1 that flows through the main primary coil 211 to generate the secondary voltage at the secondary coil 22. As a result, a discharge occurs at the ignition plug 3.

Then, after the cutoff timing at which the main primary current I1 applied to the main primary coil 211 is cut off, by turning the sub switch 54 to be ON, the sub primary current I2 flows through the sub primary coil 212. Thus, the discharge energy at the secondary coil 22 is increased. Hence, after a timing at which power supplied to the main primary coil 211 is cut off, the sub switching element 54 operates switching, whereby the discharge energy can be increased as a superimpose.

The main primary voltage measuring unit 42 is connected between the main primary coil 211 and the ignitor 23. The main primary voltage measuring unit 42 transmits the voltage at the main primary coil 211 to the ignition control circuit 55. The secondary voltage detecting unit calculates, in each cycle, calculates a secondary voltage value of the secondary coil from the voltage value of the main primary coil, based on the correlation between the voltage at the main primary coil 211 and the voltage at the secondary coil 22 after starting discharge. Other controls in the present embodiment are similar to those of any of first to fifth embodiments.

According to the present embodiment, effects and advantages which are similar to those of the sixth embodiment.

The present disclosure is not limited to the above-described embodiments. However, various modification can be made without departing the scope of the present disclosure. In the first to fifth embodiments, the discharge extension detecting unit detects the extension amount of discharge spark based on the secondary voltage. However, the discharge extension detecting unit may detect the extension amount based on the primary voltage capable of being correlated with the secondary voltage. In the case where the extension amount of the discharge spark is detected by using the primary voltage, by detecting the primary coil voltage during a period where the current supply from the secondary current adjusting unit is stopped, voltage corresponding to the winding ratio between the primary coil and the secondary coil can be detected. Thus, a detection circuit can be designed under a low voltage condition so that a small and low cost ignition device can be provided.

According to the present disclosure, a detection of short spark and a determination of movement of discharge endpoint have been explained using a change in the secondary voltage value. However, evaluation test may be repeatedly performed such that a change in the secondary voltage for each phenomena is acquired and various determination parameters are used to determine the detection timing and a determination period.

What is claimed is:

1. An ignition device of an internal combustion engine comprising:

an ignition coil having a primary coil through which a primary current flows and a secondary coil in which a secondary current is produced with a change in the primary current;

an ignition plug to which a secondary voltage generated at the secondary coil is applied to produce a discharge; and an ignition control unit that controls ignition operation of the ignition plug, wherein the ignition control unit includes:

a secondary voltage detecting unit that detects the secondary voltage;

a secondary current adjusting unit that adjusts, in each cycle, an amount of the secondary current after initiating the discharge;

a discharge extension detecting unit that detects an amount of extension of the discharge; and a short determination unit that determines whether a discharge-short has occurred based on the secondary voltage detected by the secondary voltage detecting unit, the ignition control unit is configured to control, in each cycle, the secondary current adjusting unit to repeatedly perform a first step that decreases the secondary current when the extension amount detected by the discharge extension detecting unit is a predetermined extension amount or more, and a second step that increases the secondary current when the short determination unit determines that a discharge-short has occurred; and the ignition control unit is configured to decrease, in the first step, the secondary current while keeping the secondary current higher than a predetermined lower current limit.

2. The ignition device according to claim 1, wherein an electrode of the ignition plug includes a base, and a chip connected to the base, as an end point of an initial discharge spark;

the ignition control unit includes an end point movement determination unit that determines, based on an acquisition result of the secondary voltage by the secondary voltage detecting unit, whether the end point of the discharge moves from the chip to the base; and the ignition control unit is configured to correct, in each cycle, the predetermined extension amount, based on a determination result of the end point movement determination unit.

3. The ignition device according to claim 1, wherein the ignition control unit further includes an end point movement determination unit that determines, based on an acquisition result of the secondary voltage by the secondary voltage detecting unit, whether a movement of the end point has occurred;

the ignition control unit controls, in each cycle, the secondary current adjusting unit such that an ignition energy supplied to the ignition plug is a predetermined upper limit energy or less, when the end point movement determination unit determines in each cycle that the end point of the discharge spark has moved.

4. The ignition device according to claim 1, wherein the predetermined lower current limit is a blow-off threshold defined as a minimum value of the secondary current which causes no blow-off of the discharge.

5. The ignition device according to claim 1, wherein the ignition control unit is configured to correct the predetermined lower current limit such that an energy to be supplied to the ignition plug is controlled to be a predetermined lower limit energy or more.

6. The ignition device according to claim 1, wherein the secondary voltage detecting unit is configured to measure a voltage produced at the secondary coil, thereby acquiring the second voltage.

7. The ignition device according to claim 1, wherein the primary coil includes a main primary coil and a sub primary coil which are connected in parallel to a battery;

the ignition control unit includes a main primary measuring unit that measures a main primary voltage measuring unit;

the secondary current adjusting unit is configured to adjust a current flowing through the sub primary coil, thereby adjusting the secondary current; and the secondary voltage detecting unit is configured to calculate, after initiating the discharge, the secondary voltage based on a voltage at the main primary coil which is measured by the main primary voltage measuring unit.

* * * * *